US012497847B2

(12) United States Patent
Nebiolo et al.

(10) Patent No.: US 12,497,847 B2
(45) **Date of Patent: *Dec. 16, 2025**

(54) FLUID-DRIVEN DUAL-MODE CIRCULATION TOOL

(71) Applicant: PROSHALE LLC, Spring, TX (US)

(72) Inventors: Martin Mauro Nebiolo, Neuquén Capital (AR); Cristian Brendstrup, Neuquén Capital (AR); Christian Cerne, Spring, TX (US); Gustavo Dietrich, Neuquén Capital (AR)

(73) Assignee: ProShale LLC, Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/807,147

(22) Filed: Aug. 16, 2024

(65) Prior Publication Data

US 2025/0250871 A1 Aug. 7, 2025

Related U.S. Application Data

(63) Continuation of application No. 18/589,763, filed on Feb. 28, 2024, which is a continuation-in-part of application No. 18/432,101, filed on Feb. 5, 2024.

(51) Int. Cl.

| | |
|---|---|
| ***E21B 23/00*** | (2006.01) |
| ***E21B 34/14*** | (2006.01) |
| *E21B 43/114* | (2006.01) |

(52) U.S. Cl.
CPC ..... *E21B 23/006* (2013.01); *E21B 34/142* (2020.05); *E21B 43/114* (2013.01)

(58) Field of Classification Search
CPC ..... E21B 7/065; E21B 43/114; E21B 21/10; B24C 5/04
See application file for complete search history.

(56) References Cited

U.S. PATENT DOCUMENTS

| | | | | |
|---|---|---|---|---|
| 5,794,729 | A * | 8/1998 | Van Meter | E21B 7/28 175/318 |
| 7,866,397 | B2 | 1/2011 | Lee | |
| 8,783,338 | B1 | 7/2014 | Ferguson et al. | |
| 9,494,014 | B1 | 11/2016 | Manke | |
| 10,677,024 | B2 | 6/2020 | Schultz | |
| 2014/0069648 | A1 | 3/2014 | Dotson et al. | |
| 2017/0114601 | A1* | 4/2017 | Montiel | E21B 34/10 |
| 2022/0341288 | A1 | 10/2022 | Storie et al. | |

FOREIGN PATENT DOCUMENTS

| | | |
|---|---|---|
| CA | 3036840 | 4/2020 |

* cited by examiner

*Primary Examiner* — Tara Schimpf
*Assistant Examiner* — Lamia Quaim
(74) *Attorney, Agent, or Firm* — Eric P. Mirabel, JD, LLM

(57) ABSTRACT

A fluid-driven dual-mode circulation tool which is selectively operable to switch between annular flow mode and flow-thru mode is disclosed. In the annular flow mode, fluid exits the sidewalls of the tool through one or multiple apertures. A ratchet path having mated peaks and valleys on the surface of a J-slot piston included in the tool is engaged with guiding pins. On longitudinal sliding of the piston due to guided inflow and interruption pressurized fluid through the tool, the guiding pins cause rotation of the piston. Rotation of the piston alternately aligns a pair of flow channels included in the piston with flow paths for ejecting pressurized fluid through the sidewalls of the tool and flow paths for ejection of pressurized fluid trough the lower end of the tool.

16 Claims, 12 Drawing Sheets

FLUID-DRIVEN DUAL-MODE CIRCULATION TOOL

CROSS-REFERENCE TO RELATED APPLICATION(S)

This application is a continuation-in-part of U.S. application Ser. No. 18/432,101, filed on Feb. 5, 2024.

BACKGROUND

In certain scenarios, it may be crucial to allow fluid to flow through a specific section of a drill string, while in others, it may be necessary to prevent fluid flow through a particular section. Additionally, for a circulating tool, selectively permitting or preventing flow through the sidewall of the tubular string is advantageous.

Hence, there is a need for a downhole circulating tool equipped with an adjustable fluid pressure-regulated cycle valve. Such a tool should be hydraulically controllable from the surface and allow unlimited switching between two operational modes-flow-thru or annular flow—by simply adjusting the fluid flow rate. Such a tool should be integrated into the Bottom Hole Assembly (BHA), which is conveyed through a work string, such as coiled tubing or threaded pipe, suitable for deployment in offshore and onshore wellbores across various applications, including oil and gas. The necessary adjustments are made possible through a surface pump that connects to drill work string and the BHA. Such a circulating tool would also enhance operational flexibility and efficiency in wellbore management.

SUMMARY

The present invention discloses an improved fluid-driven dual-mode circulation tool, which is operated by interrupting (or reducing) and then fully reinstating the flow of pressurized fluid through it. Interrupting and then reinstating the flow of pressurized fluid causes the tool to switch between two operating modes: flow-through mode and annular flow mode. In the flow-through mode, pressurized fluid flows out of the tool into the downhole assembly. However, in the annular-flow mode, the tool diverts fluid through internal paths that connect to the annulus of the well through one or more apertures on the sidewall of the tool.

The improved fluid-driven dual-mode circulation tool of the invention includes a J-slot piston. The J-slot piston further includes at least one pair of flow channels extending axially through it and a ratchet path including mated peaks and valleys etched on its outer surface. The ratchet path is engaged with pins on an inner wall of the tool. Downward movement of the J-slot piston causes the pins to settle between peaks of the ratchet path and induce rotation of the J-slot piston in a manner such that the pair of flow channels gets aligned with either a first set of flow paths connecting with a central bore in the tool and exiting through apertures on the sides of the tool, or with a second set of flow paths connecting with the central bore and exiting at a lower end of the tool. When the pair of flow channels gets aligned with the first set of flow paths, the tool is set in the annular flow mode, and pressurized fluid flows through the tool exits through apertures on the sides of the tool. When the pair of flow channels gets aligned with the second set of flow paths, the tool is set in flow-through mode, and the pressurized fluid flowing through the tool exits the tool into the downhole assembly.

In an embodiment of the present invention, a generally cylindrically shaped fluid-driven dual-mode circulation tool, in which interrupting and then reinstating the inflow of pressurized fluid into an upper end of the tool, allows switching between the two modes, flow-through and annular flow, comprises:

- a first set of flow paths connecting with a central bore in the tool and exiting through apertures on the sides of the tool, which provide pressurized fluid at the exits when open;
- a second set of flow paths connecting with the central bore and exiting at a lower end of the tool;
- a J-slot piston with an outer surface having a ratchet path etched around its circumference, said ratchet path having alternating peaks and valleys, and said ratchet path is engaged with one or more pins fixed on an inner wall of the tool, said J-slot piston further including at least one pair of flow channels extending axially through the J-slot piston and wherein said flow channels are alternately aligned with either the first set of flow paths or the second set of flow paths if the pins settle between peaks in the ratchet path;
- a spring that applies a force to move the J-slot piston towards the upper end of the tool such that both the first and the second set of flow paths are accessing the central bore, thereby permitting flow through both the first and the second set of flow paths, and
- wherein moving the J-slot piston down causes the pins to slide along the ratchet path and the J-slot piston to rotate until the pins settle between peaks where either the first set of flow paths or the second set of flow paths are aligned with the flow channels.

Embodiments of the present invention will be discussed in greater detail with reference to the accompanying figures in the detailed description that follows.

BRIEF DESCRIPTION OF THE DRAWINGS

FIG. 6A is a longitudinal cross-sectional view of the tool with no fluid flowing in.

FIG. 7A is a longitudinal cross-sectional view of the tool with no fluid flowing in.

It should be understood that the drawings and the associated descriptions below are intended to illustrate one or more embodiments of the present invention, and not to limit the scope or the number of different possible embodiments of the invention.

In the description of the invention which follows, unless specified otherwise, terms 'upper', 'upward' and 'upwards' are used to denote a direction upwards towards top of the well-bore or towards the source of fluid flowing through the tool. Similarly, terms 'lower', 'downward' and 'downwards' are used to denote a direction downwards towards the base of the well-bore or towards the direction of fluid flowing through the tool, which is left to right in all figures.

Some components and/or portions of the embodiments of the invention illustrated in the figures may not be fully discussed in the description which follows, because they are not needed to provide a full and complete description of the embodiments of the invention, which is adequate for comprehension by anyone with relevant experience in the field.

It should be noted that the drawings are not necessarily drawn to scale.

DETAILED DESCRIPTION

Figure 1:
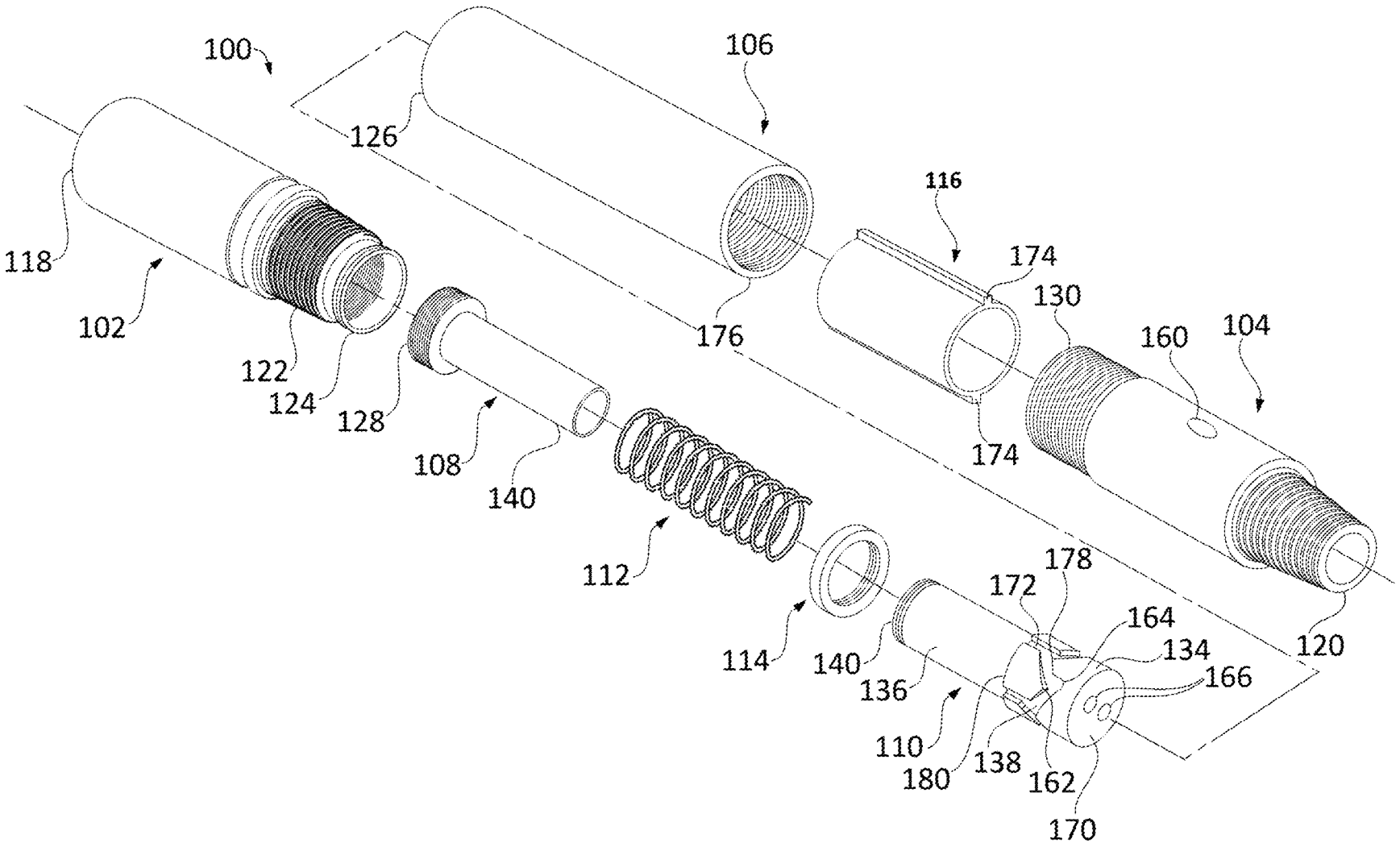
FIG. 1 is an exploded view of a first embodiment of a fluid-driven dual-mode circulation tool in accordance with the present invention.

Reference will now be made in detail to a first embodiment of a fluid-driven dual-mode circulation tool of the invention with reference to the accompanying figures. An exploded view of the first embodiment of the fluid-driven dual-mode circulation tool 100 is shown in FIG. 1. Tool 100 includes an upper sub 102, a lower sub 104, a barrel 106, a tubular centralizer 108, a J-slot piston 110, a spring 112, a retainer ring 114, and a covering sleeve 116. Other parts in FIG. 1 are discussed below.

When an assembled fluid-driven dual-mode circulation tool 100 is installed in a well-bore, an internally threaded upper end 118 of the upper sub 102 is fixed with the string or coiled tubing (or other equipment assembly in the well-bore) to receive fluid inflow. When the tool is in "neutral" or flow-through operational mode, after entering tool 100, the fluid exits through lower end 120 of lower sub 104 and gets delivered into the Bottom Hole Assembly (BHA), or other equipment assembly, connected to the externally threaded region of lower end 120.

Figure 3B:
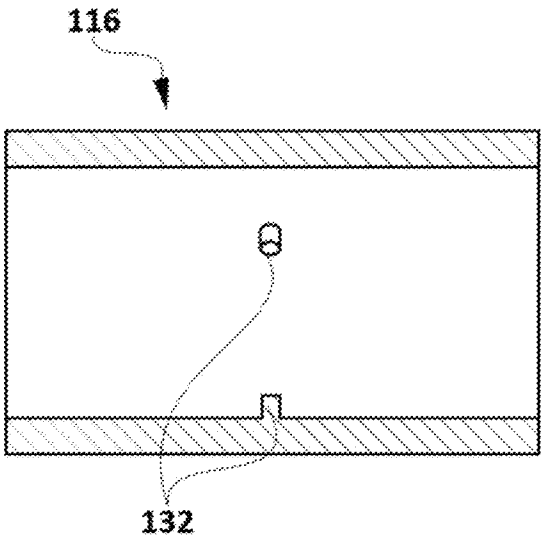
FIG. 3B is a cross-section of the covering sleeve taken along a plane MM'.
Figure 3A:
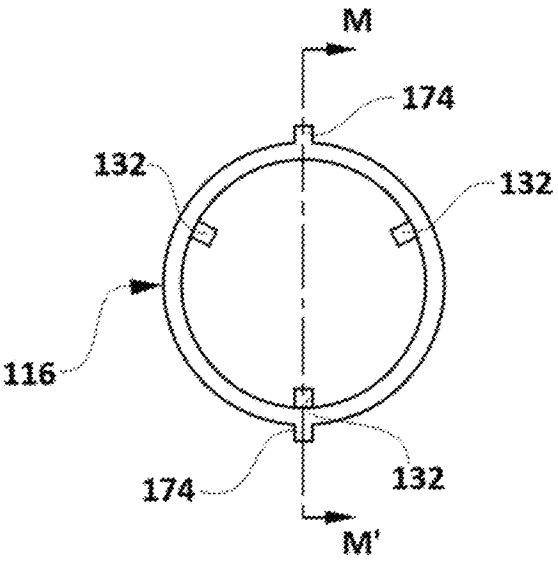
FIG. 3A is an end elevational view of a covering sleeve.

As illustrated, an externally threaded region 122 towards the lower end 124 of the upper sub 102 is screwed with an internally threaded upper end 126 of the barrel 106. An externally threaded upper end 128 of the tubular centralizer 108 is screwed within the lower end 124 of the upper sub 102. Covering sleeve 116 is housed within and towards the lower end 176 of barrel 106. The outer surface of the covering sleeve 116 includes locking keys 174 which mate within slots 182 (not shown) on the internal surface of the barrel 106, such that the covering sleeve 116 sits rotationally fixed within the barrel. The internally threaded lower end 176 of the barrel 106 is screwed with an externally threaded upper end 130 of the lower sub 104. The covering sleeve 116 further includes multiple symmetrically distributed cylindrical guiding pins 132 (explicitly illustrated in FIGS. 3A and 3B) on its internal surface. The longitudinal axis of each of the guiding pins 132 is transverse to the axis of the covering sleeve 116.

The lower sub 104 further includes a first pair of opposed flow paths 154 and a second pair of opposed flow paths 156 (see cross-sections of FIGS. 2A, 2B, 5A-5F, 6A-6C and 7A-7C). Each of the first pair of opposed flow paths 154 connect the upper end 130 of the lower sub 104 with the curved exterior of the lower sub 104. Similarly, each of the second pair of opposed flow paths 156 respectively connect the upper end 130 of the lower sub 104 and with a central bore 152 of the lower sub 104. Lower portions of each of the first pair of opposed flow paths 154 have a tapered profile and they gradually widen towards respective exit apertures 160 lying on the curved exterior of the lower sub 104. The expanded opening at the lower end 120 of central bore 152 does not extend through the lower sub 104.

Figure 4:
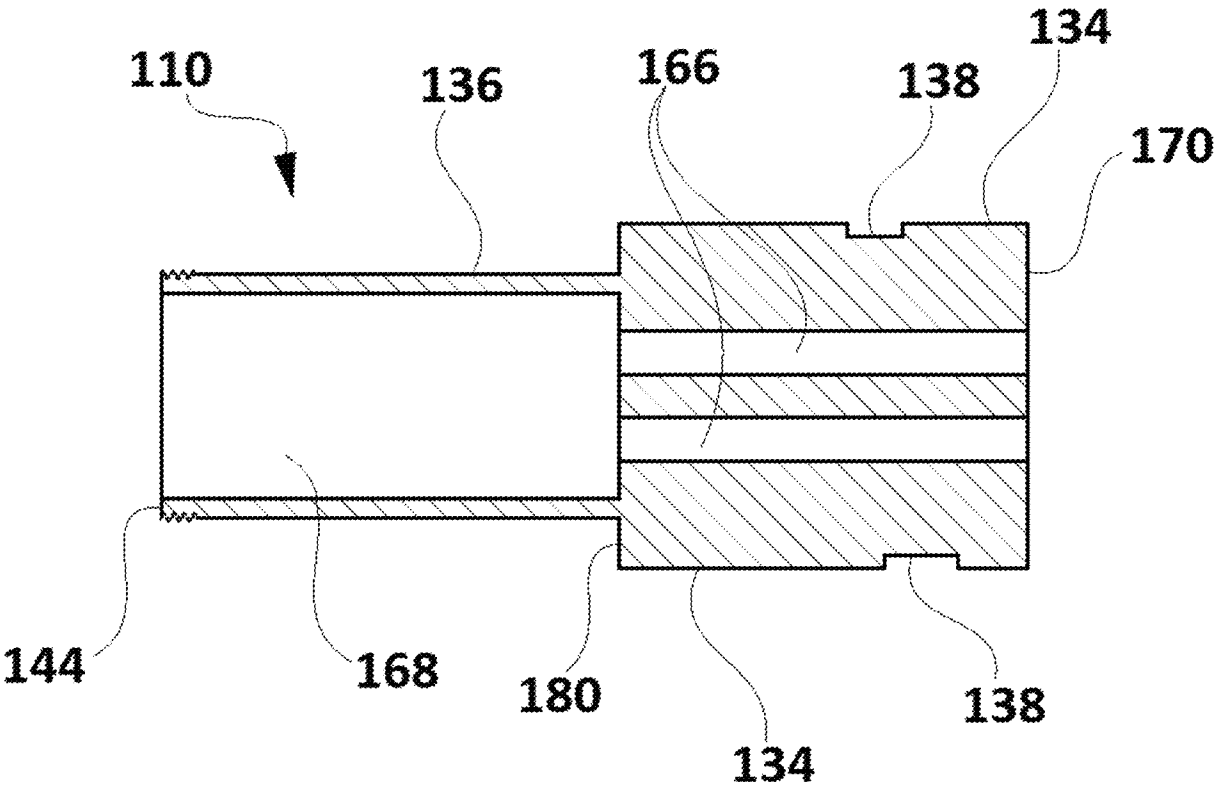
FIG. 4 is a cross-section of a J-slot piston taken along a plane passing through its longitudinal axis and through a pair of flow channels extending through it.
Figure 5B:
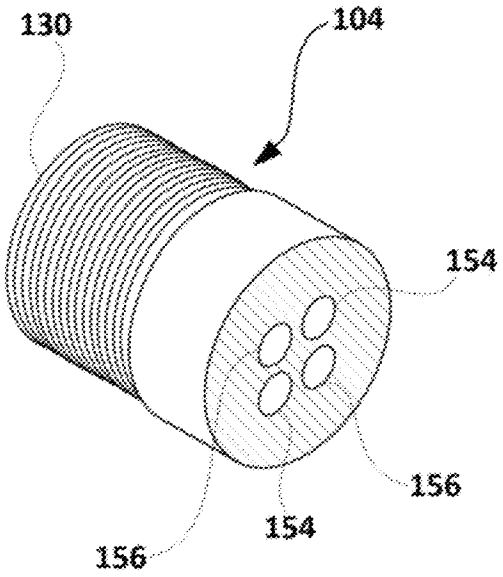
FIG. 5B is a perspective view of a cross-section of the lower sub in FIG. 5A taken along the plane ABCD.
Figure 5A:
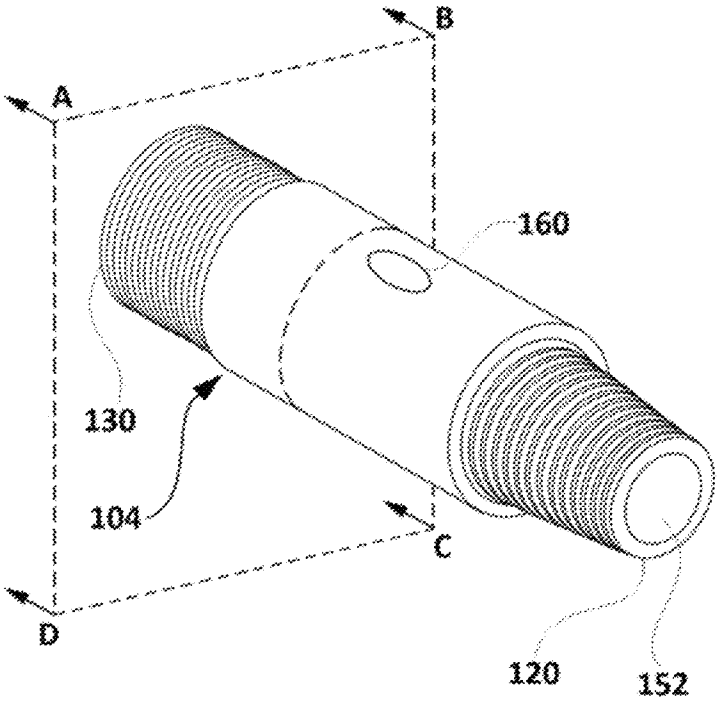
FIG. 5A perspective view of the lower sub showing the cutting plane ABCD.
Figure 5D:
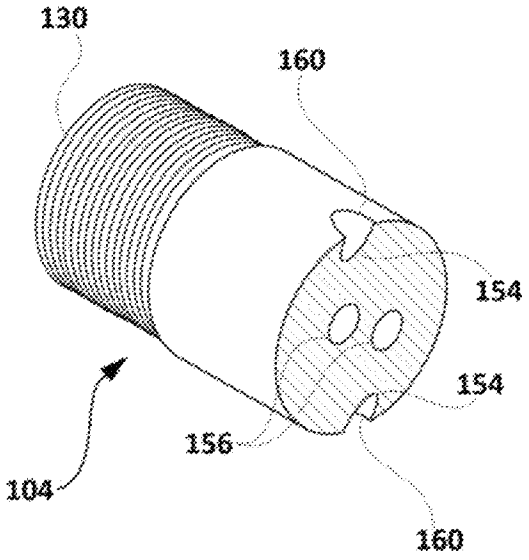
FIG. 5D is a perspective view of a cross-section of the lower sub in FIG. 5C taken along the plane EFGH.
Figure 5C:
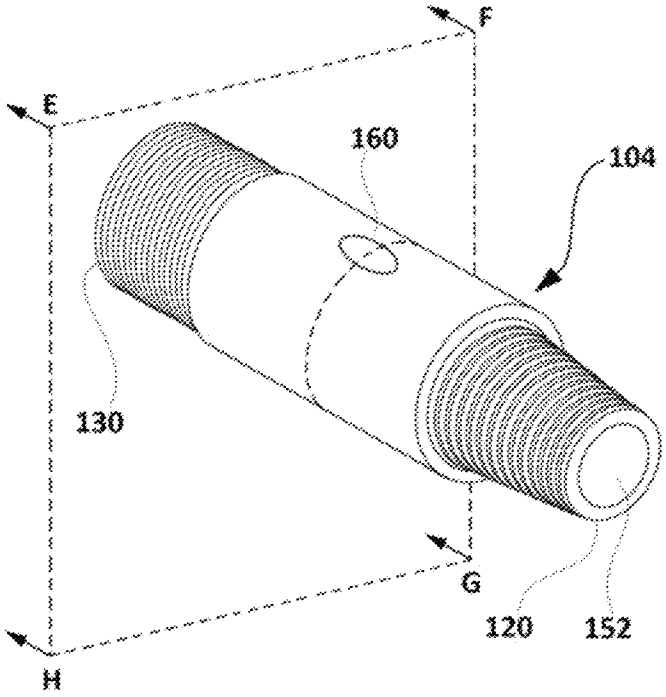
FIG. 5C is a perspective view of the lower sub in FIG. 5A showing the cutting plane EFGH.
Figure 5F:
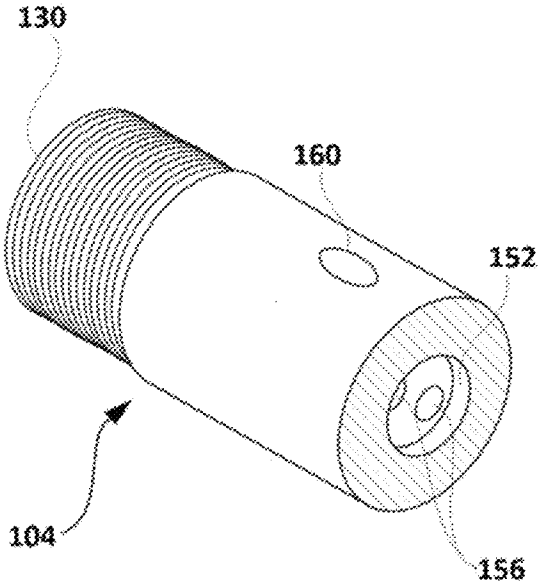
FIG. 5F a perspective view of a cross-section of the lower sub in FIG. 5E taken along the plane PQRS.
Figure 5E:
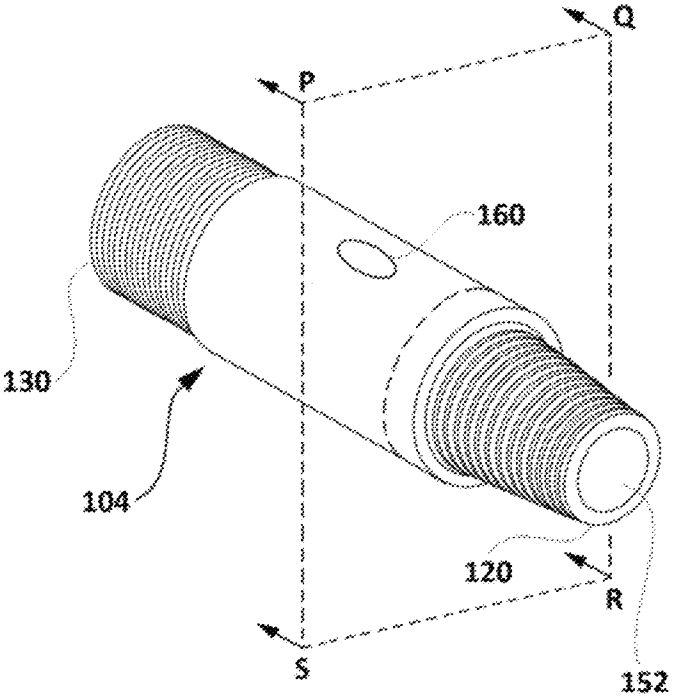
FIG. 5E is a perspective view of the lower sub in FIG. 5A showing the cutting plane PQRS.

Within the lower sub 104, each of the first pair of opposed flow paths 154 lie parallel to each other and are not interconnected. Similarly, each of the second pair of opposed flow paths 156 lie parallel to each other and are not interconnected. Also opposed flow paths 154 are not connected to the second pair of opposed flow paths 156. J-slot piston 110 is housed within barrel 106 and can slide between limits within it. The J-slot lot piston 110 further includes ratchet head 134 and a tubular shaft 136. On the ratchet head 134, a ratchet path 138 is formed by etching the outer curved surface of the ratchet head 134 to form multiple mating peaks 162 and valleys 164. Multiple peak channels 172 are included between adjacent peaks 162, and multiple valley crests 178 are included between adjacent valleys 164. In an assembled tool 100 (as shown in FIGS. 2A, 2B, 6A-6C, and 7A-7C), the ratchet head 134 is housed within the covering sleeve 116 in a manner such that the guiding pins 132 are engaged within the ratchet path 138. The tubular shaft 136 is a hollow tube including a central bore 168. Within the ratchet head 134, the J-slot piston 110 further includes a pair of flow channels 166 which extend axially through the ratchet head 134 (see FIGS. 1 and 4). Each of the flow channel 166 connect the central bore 168 with a lower end 170 of the ratchet head 134.

The tubular shaft 136 slidably covers at least a partial length of a lower hollow shaft 140 of the tubular centralizer 108. The ratchet head 134 is confined to slide between the upper end 130 of the lower sub 104 and an annular restriction 142 on the internal surface of the barrel 106. Since the guiding pins 132 are engaged with the ratchet path 138, sliding of the ratchet head 134 between the upper end 130 of the lower sub 104 and the annular restriction 142 causes its rotation. Irrespective of whether the ratchet head 134 slides from the upper end 130 of the lower sub 104 to the annular restriction 142, or whether it slides from the annular restriction 142 to the upper end 130 of the lower sub 104, the direction of rotation of the ratchet head 134 (and hence the J-slot piston 110) always remains the same. Dimensions and mating of the peaks 162, valleys 164 and peak channels 172 of the ratchet path 138 are chosen such that every complete downward slide of the ratchet head 134, after its complete upward slide, causes its rotation by a prefixed angle such that, every time the lower end 170 of the ratchet head 134 strikes and pushes against the upper end 130 of the lower sub 104, the flow channels 166 get alternately aligned with the first pair of opposed flow paths 154 and the second pair of opposed flow paths 156. When the lower end 170 of the ratchet head 134 strikes and pushes against the upper end 130 of the lower sub 104, and when the flow channels 166 get aligned with the first pair of opposed flow paths 154, the entrances to the second pair of opposed flow paths 156 remains sealed. Similarly, When the lower end 170 of the ratchet head 134 strikes and pushes against the upper end 130 of the lower sub 104, and when the flow channels 166 get aligned with the second pair of opposed flow paths 156, the entrances to the first pair of opposed flow paths 154 remains sealed.

The tubular shaft 136 is further surrounded by the spring 112 and the retainer ring 114 is screwed on the externally threaded upper end 144 of the tubular shaft 136 (or of the J-slot piston 110). The span of spring 112 is confined to be within the separation of annular restriction 142 and the retainer ring 114.

In the assembled tool 100, a central bore 146 of the upper sub 102, a central bore 148 of the tubular centralizer 108, the central bore 168 (shown in FIGS. 6A-6C, and 7A-7C) of the J-slot piston 110 and a central bore 150 of the barrel 106 are axially aligned (See FIGS. 2A, 2B, 6A-6C, and 7A-7C).

The operation of the assembled fluid-driven dual-mode circulation tool 100, when deployed in a coiled tubing of a well-bore will now be explained with the help of accompanying figures.

Figure 2A:
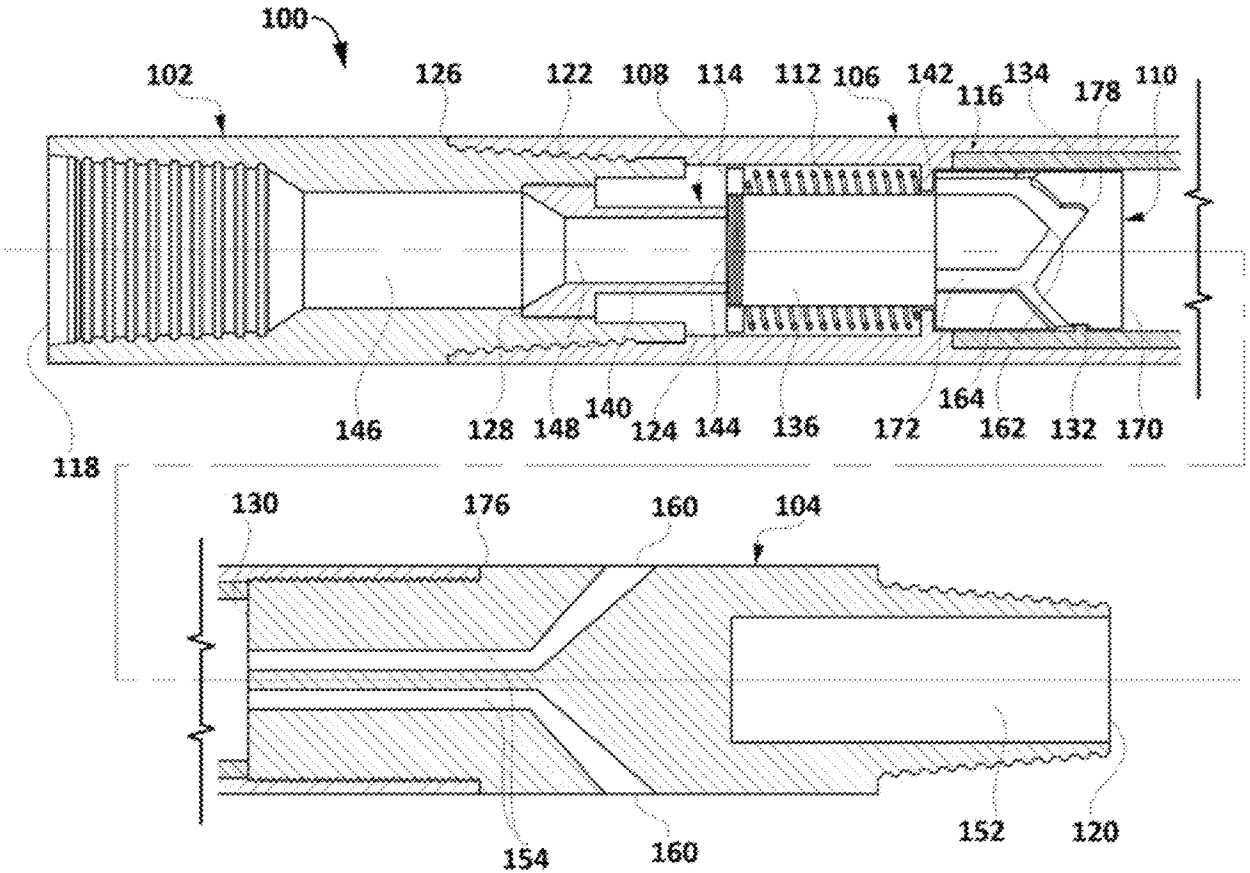
FIG. 2A is a longitudinal cross-sectional view of the assembled first embodiment of the fluid-driven dual-mode tool, positioned at rest prior to fluid flow but with the J-slot piston not shown in the cross-section.
Figure 2B:
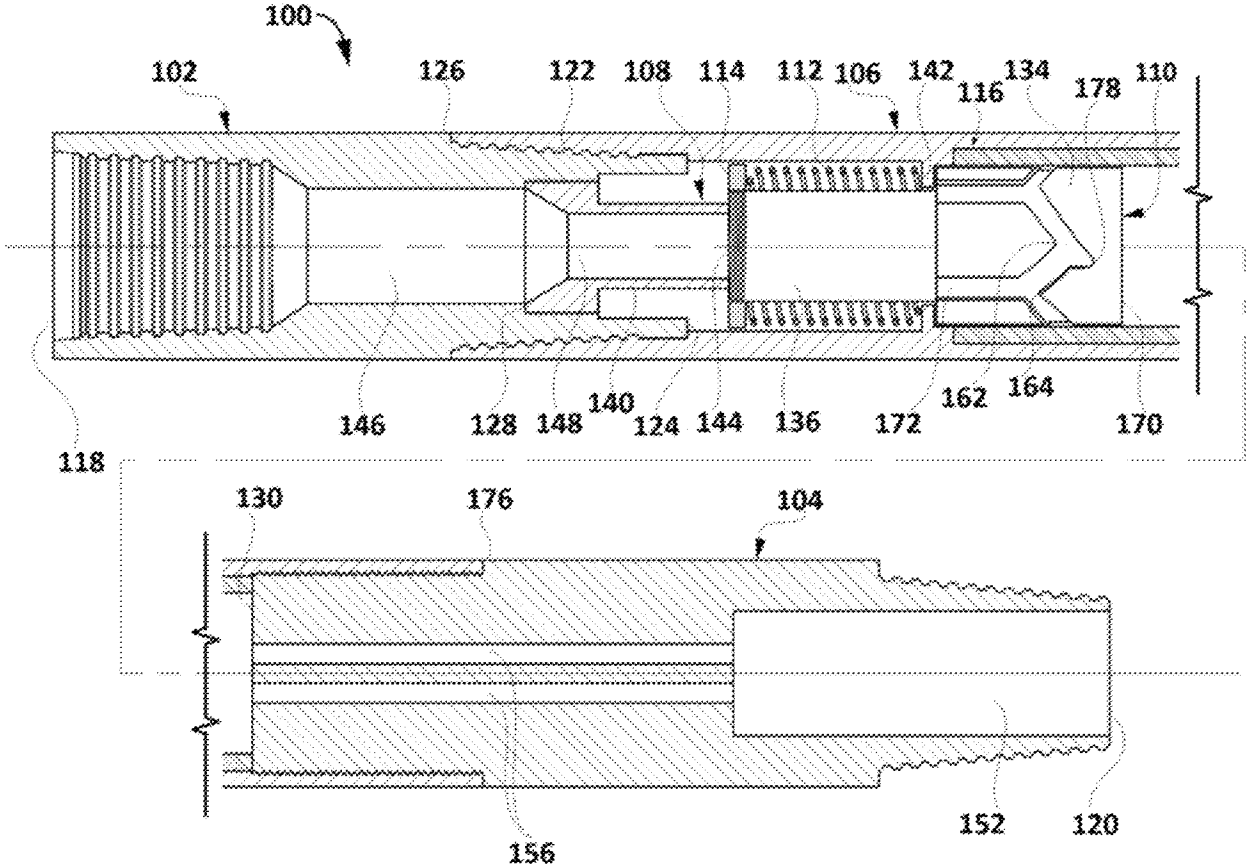
FIG. 2B is a second longitudinal cross-section, where this second cutting plane is at 90 degrees from the cutting plane of the first longitudinal cross-section of FIG. 2A, where the same tool is in the same position at rest prior to fluid flow, but with the J-slot piston not shown in cross-section.
Figure 6A:
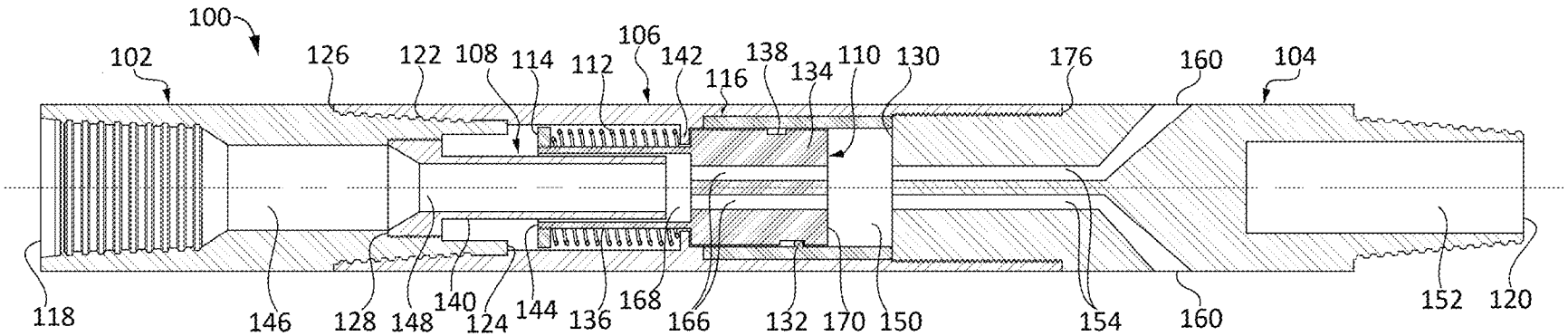

FIGS. 2A and 6A illustrate state of tool 100 in a state of rest with no fluid entering. In this state, the spring 112 is in expanded state and the ratchet head 134 lies adjacent to the annular restriction 142. The entrances to first pair of opposed flow paths 154 and the second pair of opposed flow paths 156 are open.

To circulate the fluid through the conveyance work string and out of the apertures 160 on the side wall of the tool 100, pressurized fluid is injected into upper sub 102 (from upper end 118). From the upper sub 102, pressurized fluid travels through the central bores 146, 148, and then through the pair of flow channels 166 (see FIG. 6A) to get delivered into the central bore 150 of the barrel 106. Finally, the pressurized fluid travels through the first pair of opposed flow paths 154 and the second pair of opposed flow paths 156, and gets ejected out of the tool 100 through fluid exit apertures 160 and through the lower end 120 of the lower sub 104. Downflow of pressurized fluid against the restrictions presented by flow channels 166 exerts a downward force on the J-slot piston 110. As a result, the J-slot piston 110 is pushed downwards.

Figure 6B:
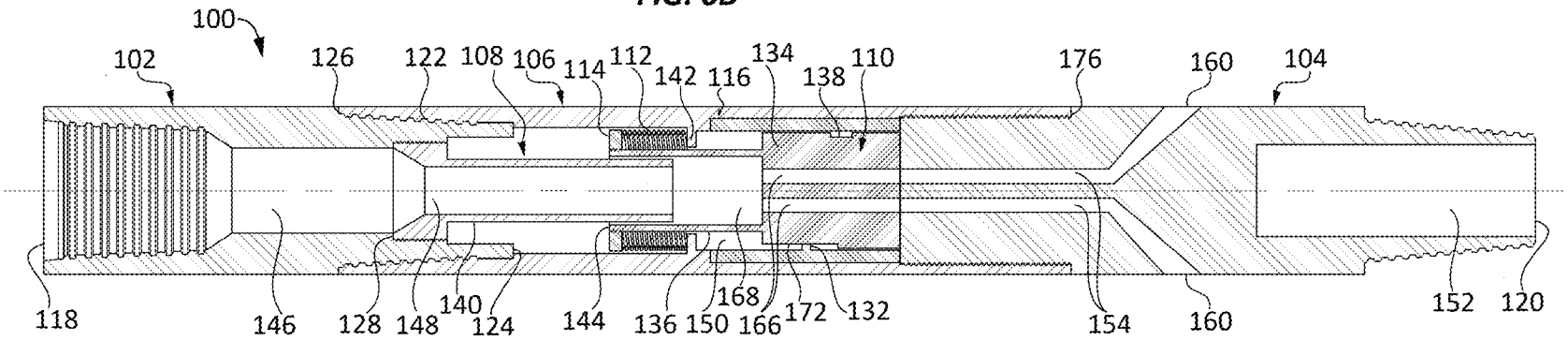
FIG. 6B is a longitudinal cross-sectional view of the annular flow mode of operation of the tool, where after inflow commences, flow is ejected through the ports on the sides.
Figure 6C:
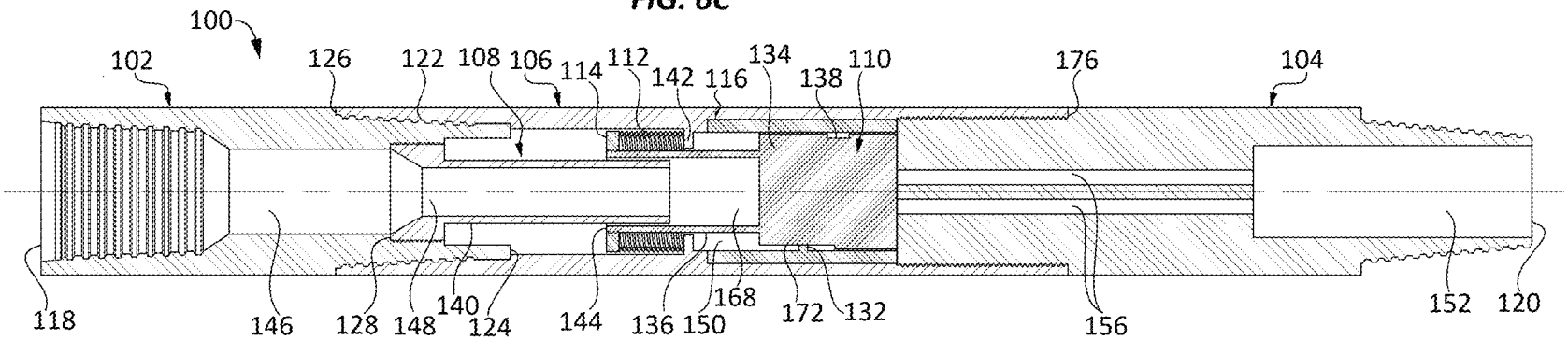
FIG. 6C is a longitudinal cross-sectional view of the annular flow mode of operation of the tool as in FIG. 6B, except that the cross-section of FIG. 6C is taken from a plane which is transverse to the cutting plane of FIG. 6B.

As the J-slot piston 110 moves downwards under the pressure of the inflowing fluid, the spring 112 gets compressed, and the peaks 162 of the ratchet path 138 push against guiding pins 132 of sleeve 116 (See FIGS. 6B-6C). Since the sleeve 116 (and pins 132) are rotationally fixed within the barrel 106, the edges of the peaks 162 slide against pins 132 causing the ratchet head 134 (and the entire J-slot piston 110) to rotate until the pins 132 enter and fall into the peak channels 172. Once pins 132 fall into peak channels 172, the ratchet head 134 is freely pushed downwards such that the lower end 170 strikes against and pushes on the upper end 130 of the lower sub 104 (see FIG. 6B). Longitudinal downward displacement of the J-slot piston 110 also results in further compression of spring 112. At this stage, the flow channels 166 of the ratchet head 134 get aligned with the first pair of opposed flow paths 154 (i.e. the entrances of the first pair of opposed flow paths 154 get aligned with the exits of the flow channels 166), and the entrances of the second pair of opposed flow paths 156 get sealed by the lower end 170 of the ratchet head 134 (see FIG. 6C).

Since the second pair of opposed flow paths 156 get sealed, the pressurized fluid flowing through the tool 100 finally travels only through the first pair of opposed flow paths 154 and gets ejected from fluid exit apertures 160, for circulation a target site. At this stage, the tool 100 works in 'annular flow' mode.

Next, when it is desired to switch off the 'annular flow' mode and to make the tool 100 operate in flow-through mode, flow of pressurized fluid through the tool 100 is interrupted (or the fluid pressure is reduced below a threshold) in order to reduce downward compression force on the spring 112. As the fluid pressure is reduced, the downward pressure on the J-slot piston 110 is reduced, and spring 112 expands and pushes the retainer ring 114 upwards.

Figure 7A:
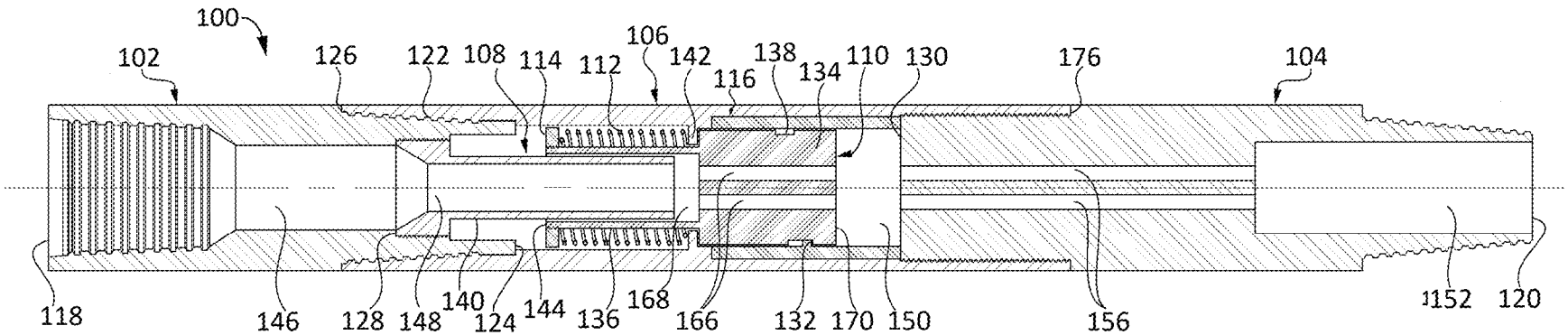
Figure 7B:
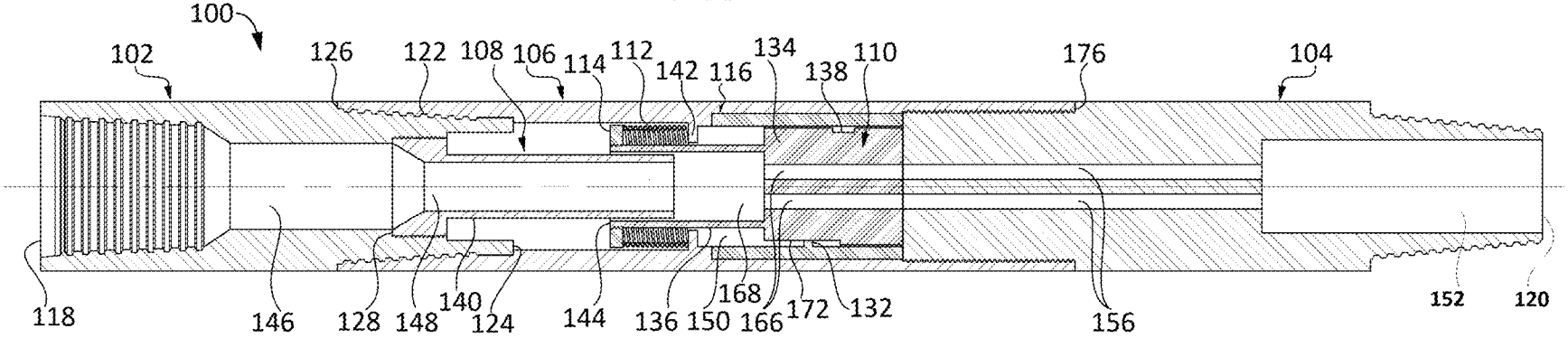
FIG. 7B is a longitudinal cross-sectional view of the flow-through mode of operation of the tool, where after inflow commences, flow is ejected through the lower sub of the tool.
Figure 7C:
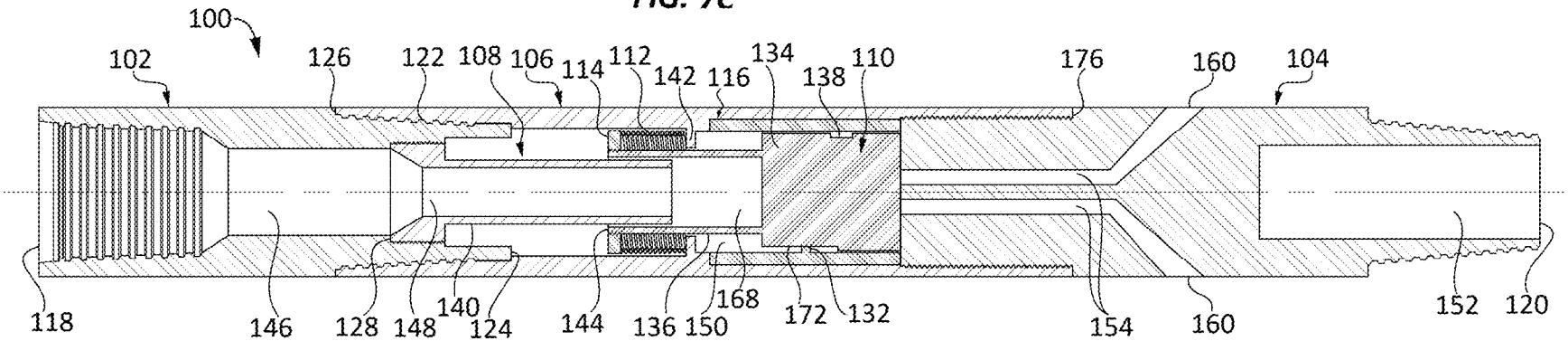
FIG. 7C is a longitudinal cross-sectional view of the flow-through mode of operation of the tool as in FIG. 7B, except that the cross-section of FIG. 7C is taken from a plane which is transverse to the cutting plane of FIG. 7B.

As a result of upward force on the retainer ring 114, the entire J-slot piston 110 (including the ratchet head 134) is pulled upwards (See FIG. 7A). This causes the valley crests 178 of the ratchet path 138 to hit and push against guiding pins 132 of sleeve 116. Since the sleeve 116 (and pins 132) are rotationally fixed within the barrel 106, the edges of the valley crests 178 slide against pins 132 causing the ratchet head 134 (and the entire J-slot piston 110) to rotate until the pins 132 fall into an adjacent valley 164. This causes the ratchet head 134 to be pushed upwards such that its upper end 180 strikes against and pushes on the annular restriction 142 on the internal surface of the barrel 106 (see FIG. 7A). At this stage spring 112 achieves maximum expansion, and since the lower end 170 of ratchet head 134 moves away from the upper end 130 of the lower sub 104, the entrances of the flow paths 154 and 156 are unsealed.

At this stage, reinstating the pressurized fluid flow causes the J-slot piston 110 to slide downwards under the pressure of the inflowing fluid. As the J-slot piston 110 slides downwards, spring 112 gets compressed, and the peaks 162 of the ratchet path 138 push against guiding pins 132 of sleeve 116 (See FIGS. 7B-7C). Since the sleeve 116 (and pins 132) are rotationally fixed within the barrel 106, the edges of the peaks 162 slide against pins 132 causing the ratchet head 134 (and the entire J-slot piston 110) to rotate until the pins 132 enter and fall into the peak channels 172. Once pins 132 fall into peak channels 172, the ratchet head 134 is pushed downwards such that the lower end 170 strikes against and pushes on the upper end 130 of the lower sub 104. Complete longitudinal downward displacement the J-slot piston 110 also results in further compression of spring 112. At this stage, the flow channels 166 of the ratchet head 134 get aligned with the second pair of opposed flow paths 156 (i.e. the entrances of the second pair of opposed flow paths 156 get aligned with the exits of the flow channels 166), and the entrances of the first pair of opposed flow paths 154 get sealed by the lower end 170 of the ratchet head 134 (see FIG. 7C).

Since the first pair of opposed flow paths 154 get sealed, the pressurized fluid flowing through the tool 100 travels only through the second pair of opposed flow paths 156 gets delivered into bore 152 and finally gets ejected out of the tool from lower end 120 of the lower sub 104. The tool 100 is operating in flow-through mode.

Thereafter, again interrupting and reinstating the flow of pressurized fluid causes the J-slot piston 110 to again strike and push against the upper end 130 of the lower sub and causes the tool 100 to switch operation to the 'annular flow' mode as explained above.

It is noted that during longitudinal displacement of the J-slot piston 110, the tubular shaft 136 (along with its upper end 144) also gets displaced longitudinally by sliding over the lower hollow shaft 140 of the tubular centralizer 108. The presence of lower hollow shaft 140 within the central bore 168 of the tubular shaft 136 minimizes longitudinal deviations of the J-slot piston 110 during its longitudinal displacement. Hence, guided longitudinal displacement of the J-slot piston 110 due to the lower hollow shaft 140 of the tubular centralizer 108 ensures smooth longitudinal displacements (with minimal deviations) of the J-slot piston 110. This also results in smoother operation of tool 100.

The specifications of the spring 112 in terms of the fluid pressure required to cause its compression and expansion during operation of the tool are fixed. So, the amount of fluid pressure which would overcome the force of spring 112 and push the J-slot piston 110 down, and the amount of fluid pressure which would not withstand the expansive force of compressed spring 112 are known to the operator of the tool.

In other possible embodiments of the present invention, instead of a single pair of flow channels (as described above), the J-slot piston may include an additional pair of flow channels. During operation, every time when the J-slot piston pushes against the upper end of the lower sub, while the first pair of flow channels would always get aligned with either of the first pair or the second pair of flow paths, the second pair of flow channels would always get aligned with the other pair of flow paths. However, the exits of the additional pair of flow channels may be kept blocked by a sealing mechanism. In an embodiment of the invention, such a sealing mechanism could be implemented by screwing externally threaded cylindrical plugs (made of an elastomeric material) into internally threaded exits of each of the additional pair of flow channels. When aligned with either pair of flow paths, a protrusion of such plugs would also block the entrance of the flow path they would push against. Other mechanisms to seal and block the flow path, other than protrusions or plugs, could also be used and are within the scope of the invention.

It is to be noted that apart from the tapered profile of lower portions of each of the first pair of flow paths as described in the embodiment above, other possible profiles are also within the scope of the invention. For example, in other embodiments of the invention, each of the first pair of flow paths may have a step profile wherein, the diameter of each of the first pair of flow paths increases in steps towards their respective exits. Still further, in other embodiments of the invention, each of the first pair of flow paths may have a uniform diameter throughout their length.

It is to be understood that the foregoing description and embodiments are intended to merely illustrate and not limit the scope of the invention. Other embodiments, modifications, variations and equivalents of the invention are apparent to those skilled in the art and are also within the scope of the invention, which is only described and limited in the claims which follow, and not elsewhere.

What is claimed is:

1. A fluid-driven dual-mode circulation tool, having a generally cylindrically shaped outer wall, wherein interrupting and then reinstating the inflow of pressurized fluid into an upper end of the tool allows to switch between a flow-through mode of operation and an annular flow mode of operation, comprising:

a first set of flow paths connecting with a central bore in the tool and exiting through the outer wall of the tool, which provide pressurized fluid at the exits when open;

a second set of flow paths connecting with the central bore and exiting at a lower end of the tool;

a J-slot piston with an outer surface having a ratchet path etched around its circumference, said ratchet path having alternating peaks and valleys, and said ratchet path is engaged with one or more guiding pins fixed on an inner wall of the tool, said J-slot piston further including at least one pair of flow channels extending axially through the J-slot piston and wherein said flow channels are alternately aligned with either the first set of flow paths or the second set of flow paths if the pins reside between peaks in the ratchet path;

a spring that applies a force to move the J-slot piston towards the upper end of the tool such that both the first and the second set of flow paths are accessing the central bore, thereby permitting flow through both the first and the second set of flow paths; and wherein moving the J-slot piston down causes the pins to slide along the ratchet path and the J-slot piston to rotate until the pins set in between peaks where either the first set of flow paths or the second set of flow paths are aligned with the flow channels.

2. The fluid-driven dual-mode circulation tool of claim 1, wherein at least a portion of each of the first set of flow paths located towards their respective exits on the outer wall, widens.

3. The tool of claim 1, wherein inflow of pressurized fluid causes compression of said spring.

4. The tool of claim 3, wherein the spring force upward is known and the fluid pressure inflow required to move the J-slot piston up or down is selected based on the known spring force upward.

5. The tool of claim 1, further including an upper sub where pressurized fluid enters the tool, a lower sub where pressurized fluid from the second set of flow paths exits the tool, and a barrel joining the upper sub with the lower sub.

6. The tool of claim 1, further including a sleeve fixed to the inner wall of the tool which has the pins attached on its interior surface.

7. The tool of claim 1, wherein there are a pair of paths in the first set of flow paths and a pair of paths in the second set of flow paths.

8. The tool of claim 1 wherein the alignment of either the first set of flow paths or the second set of flow paths with the pair flow channels is achieved when the J-slot piston pushes against the entrances the first set of flow paths and the second set of flow paths.

9. The tool of claim 8 wherein pushing of the J-slot piston against the entrances the first set of flow paths and the second set of flow paths causes sealing of the entrances of either the first set of flow paths or the second set of flow paths.

10. A method of circulating pressurized fluid to the annulus using a fluid-driven dual-mode circulation tool, the method comprising:

providing a fluid-driven dual-mode circulation tool, having a generally cylindrically shaped outer wall, and further having:

a first set of flow paths connecting with a central bore in the tool and exiting through the outer wall of the tool, which provide pressurized fluid at the exits when open;

a second set of flow paths connecting with the central bore and exiting at a lower end of the tool;

a J-slot piston with an outer surface having a ratchet path etched around its circumference, said ratchet path having alternating peaks and valleys, and said ratchet path is engaged with one or more guiding pins fixed on an inner wall of the tool, said J-slot piston further including at least one pair of flow channels extending axially through the J-slot piston and wherein said flow channels are alternately aligned with either the first set of flow paths or the second set of flow paths if the pins reside between peaks in the ratchet path;

a spring that applies a force to move the J-slot piston towards the upper end of the tool such that both the first and the second set of flow paths are accessing the central bore, thereby permitting flow through both the first and the second set of flow paths, and wherein moving the J-slot piston down causes the pins to slide along the ratchet path and the J-slot piston to rotate until the pins set in between peaks where either the first set of flow paths or the second set of flow paths are aligned with the flow channels;

placing the tool proximal to the target and initiating an inflow of pressurized fluid into the tool to cause the J-slot piston to slide and open the first set of flow paths; and ejecting jets of pressurized fluid from the exits of the first set of flow paths against said target.

11. The method of claim 10 wherein the alignment of either the first set of flow paths or the second set of flow paths with the pair of flow channels is achieved when the J-slot piston pushes against the entrances the first set of flow paths and the second set of flow paths.

12. The method of claim 11 wherein pushing of the J-slot piston against the entrances the first set of flow paths and the second set of flow paths causes sealing of the entrances of either the first set of flow paths or the second set of flow paths.

13. The method of claim 10 further including stopping then reinstating the inflow of pressurized fluid to open the second set of flow paths and to close the first set of flow paths and stop the jets of pressurized fluid from being ejected.

14. The method of claim 13 further including stopping then reinstating the inflow of pressurized fluid to close the second set of flow paths and to open the first set of flow paths thereby starting the jets of pressurized fluid again being ejected.

15. The method of claim 10, wherein interrupting the inflow of pressurized fluid causes decompression of the spring and sliding of the J-slot piston in a longitudinal direction.

16. The method of claim 10, wherein each of the first set of flow paths widens towards their respective exits on the outer wall.

* * * * *